US006144689A

United States Patent [19]

Schmialek et al.

[11] Patent Number: 6,144,689

[45] Date of Patent: Nov. 7, 2000

[54] COOLING PLATE FOR SHAFT FURNACES

[75] Inventors: Karl-Heinz Schmialek, Hilchenbach; Hartmut Hille, Moers; Werner Otremba, Oberhausen; Peter Heinrich, Geldern, all of Germany

[73] Assignee: SMS Schloemann-Siemag Aktiengesellschaft, Düsseldorf, Germany

[21] Appl. No.: 09/225,628

[22] Filed: Jan. 5, 1999

[30] Foreign Application Priority Data

Jan. 16, 1998 [DE] Germany ..... 198 01 425

[51] Int. Cl.[7] ..... F27D 1/12

[52] U.S. Cl. ..... 373/76; 373/74

[58] Field of Search ..... 373/71, 73, 74, 373/75, 76

[56] References Cited

U.S. PATENT DOCUMENTS

| | | | |
|---|---|---|---|
| 3,838,665 | 10/1974 | Astrom | 373/76 |
| 4,097,679 | 6/1978 | Fukumoto et al. | 373/76 |
| 4,119,792 | 10/1978 | Elsner et al. | 373/76 |
| 4,122,295 | 10/1978 | Nanjyo et al. | 373/76 |
| 4,135,575 | 1/1979 | Gersch | 373/76 |
| 4,161,620 | 7/1979 | Nakamura | 373/76 |
| 4,205,720 | 6/1980 | Epstein | 165/169 |
| 4,342,118 | 7/1982 | Tinchant | 373/76 |
| 4,410,999 | 10/1983 | Wabersich et al. | 373/76 |
| 4,453,253 | 6/1984 | Lauria et al. | 373/74 |
| 5,426,664 | 6/1995 | Grove | 373/76 |

FOREIGN PATENT DOCUMENTS

| | | |
|---|---|---|
| 2907511 | 3/1986 | Germany . |
| 4035893 | 1/1992 | Germany . |

*Primary Examiner*—Tu Ba Hoang
*Attorney, Agent, or Firm*—Friedrich Kueffner

[57] ABSTRACT

A cooling plate for shaft furnaces, particularly blast furnaces, is provided with a refractory lining and is composed of copper or a low-alloy copper alloy with cooling medium ducts, wherein the cooling plate is made from a wrought or rolled ingot, and wherein the cooling plate has on one side thereof, i.e., the front side, grooves for receiving refractory material. Cooling ducts are provided on the rear side of the cooling plate, wherein the cooling ducts are defined in part by the cooling plate itself and in part by sheet metal or sheet steel, wherein the cooling ducts are produced by milling cutting in the rear sides of the cooling plate and/or the sheet metal or sheet steel.

8 Claims, 2 Drawing Sheets

COOLING PLATE FOR SHAFT FURNACES

BACKGROUND OF THE INVENTION

1. Field of the Invention

The present invention relates to cooling plates for shaft furnaces, particularly blast furnaces, provided with a refractory lining. The cooling plates are composed of copper or a low-alloy copper alloy with cooling medium ducts, wherein the cooling plates are made from a wrought or rolled ingot, and wherein the cooling plates have on one side thereof, i.e., the front side, grooves for receiving refractory material.

2. Description of the Related Art

Cooling plates of the above-described type are disclosed in German Patent 29 07 511. In these cooling plates, the cooling ducts are provided in the wrought or rolled ingot in the form of vertically extending blind-end bores which are produced by mechanical deep drilling. Cooling plates of this type must have a relatively great thickness to make it possible to bore the cooling ducts without impairing the stability of the cooling plates. On the front sides as well as on the rear sides of the cooling plates sufficient copper material must remain in the areas of the bores in order to ensure that the cooling plates have sufficient strength. Consequently, very thick copper plates are required which are correspondingly very expensive because of the high price of copper.

Since the cooling ducts are produced by drilling into the cooling plates, only circular holes can be made. These circular blind-end bores have only relatively small surfaces at which the required heat exchange from the cooling plates to the cooling medium can take place. Consequently, only a poor heat transfer is achieved.

SUMMARY OF THE INVENTION

Therefore, it is the primary object of the present invention to construct cooling plates of the above-described type in such a way that they are less expensive and better cooling efficiencies can be achieved.

In accordance with the present invention, cooling ducts are provided on the rear sides of the cooling plates, wherein the cooling ducts are defined in part by the cooling plate itself and in part by sheet metal or sheet steel, wherein the cooling ducts are produced by milling cutting in the rear sides of the cooling plates and/or the sheet metal or sheet steel.

The configuration according to the present invention makes it possible to use substantially thinner cooling plates because it is only necessary to provide one web of suitable thickness between the front side and the cooling duct. The second part of the cooling duct can be formed by other material, such as steel, which may have a much smaller thickness.

Since the cooling ducts are produced by milling the cooling plates, any desired cross-sectional shapes and patterns of the cooling ducts may be realized. It is not necessary, as is the case in blind-end bores, to produce always straight ducts. This makes it possible to place the cooling ducts at any desired location of the cooling plates, so that the cooling plates can be cooled more uniformly.

If ducts with great widths and small depths are selected, large surface areas of the cooling plates are directly contacted by the cooling medium, so that a high heat discharge is possible.

The cooling ducts provided on the cooling plate can be closed off by individual sheet metal pieces or an entire plate.

It is essential that the ducts are closed off tightly, for example, by welding or screwing the sheet metal pieces or plates to the cooling plates.

It is certainly also possible to weld cooling plates constructed with the cooling ducts against a flat rear side of the cooling plate. These sheet metal pieces can be manufactured, for example, by deep-drawing or bending, so that the manufacturing costs for the cooling plates are especially low. In that case, particularly thin cooling plates can be manufactured which, in turn, means that expensive copper can be saved.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
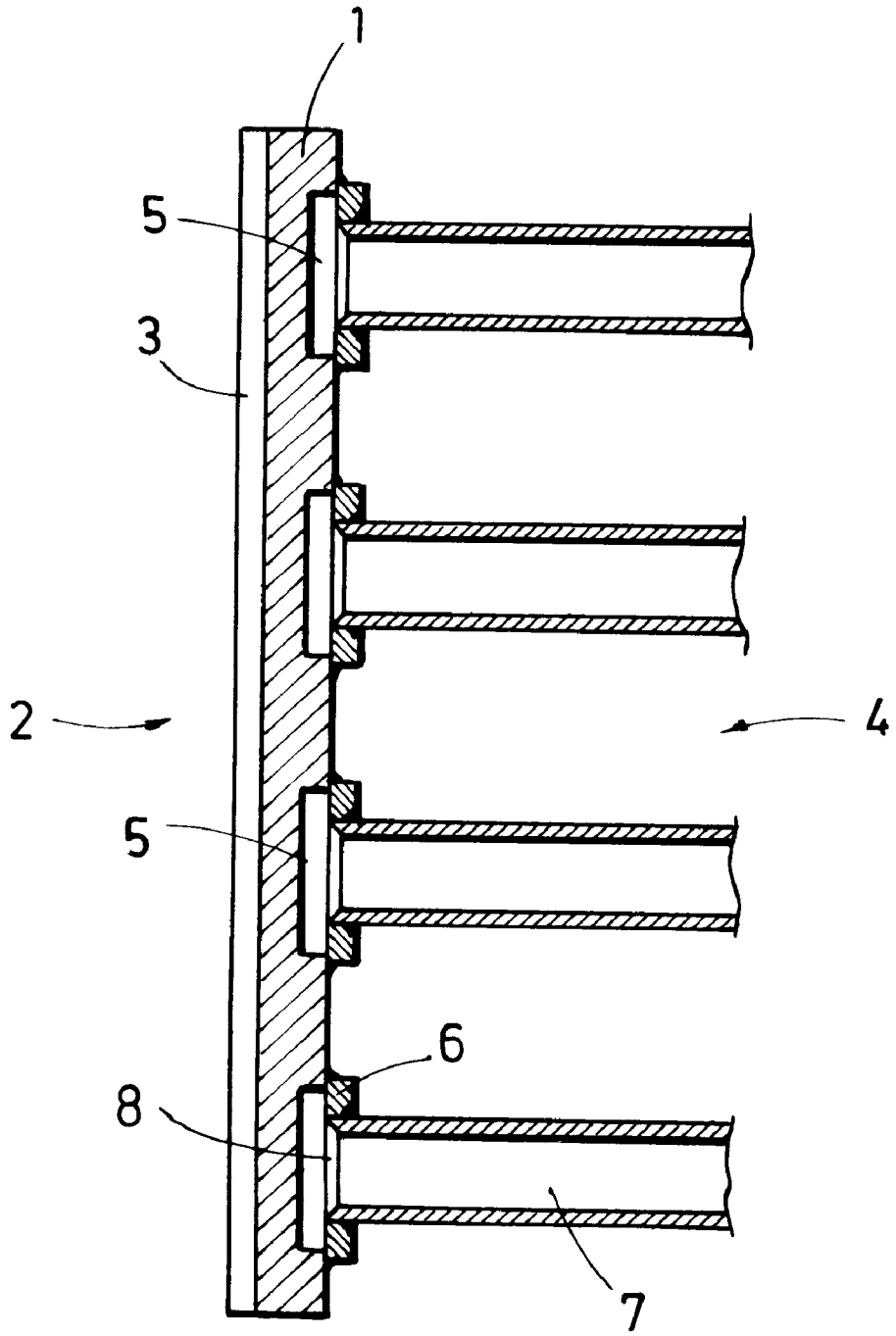
FIG. 1 is a cross-sectional view of a cooling plate with several cooling ducts.

FIG. 1 of the drawing shows a cooling plate 1 which on its front side 2 has grooves 3 which are intended for receiving refractory material.

Cooling medium ducts 5 are milled into the rear side 4 of the cooling plate 1. These ducts are not milled very deep into the rear side 4, however, they have a relatively great width. The ducts 5 are closed by sheet metal or steel pieces 6. The sheet metal or steel pieces 6 are welded onto the cooling plate 1.

The sheet metal or steel pieces 6 simultaneously serve to receive supply and discharge lines 7 for the cooling medium. The supply and discharge lines 7 are welded into the bores 8 of the sheet metal or steel pieces 6.

Figure 2:
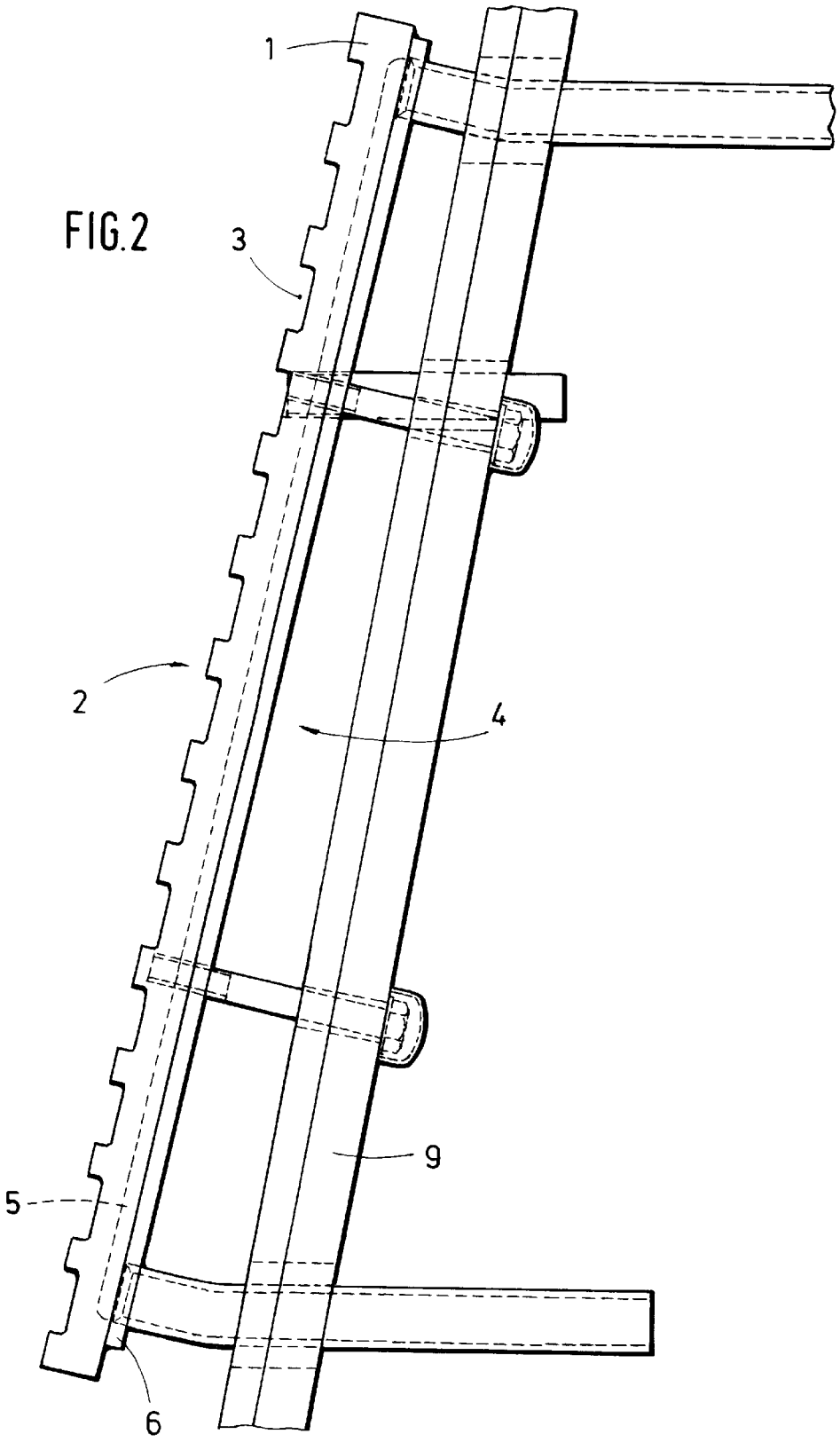
FIG. 2 is a side view of a cooling plate mounted in a blast furnace.

FIG. 2 shows the inner wall 9 of a blast furnace with a cooling plate 1 screwed onto the inner wall 9. In this case, the rear side 4 of the cooling plate provided with the cooling medium ducts 5 is not closed by a plurality of sheet metal or steel pieces 6, but by a single plate 6'.

The invention is not limited by the embodiments described above which are presented as examples only but can be modified in various ways within the scope of protection defined by the appended patent claims.

We claim:

1. A cooling plate for shaft furnaces, provided with a refractory lining, wherein the cooling plate is composed of copper or a low-alloy copper alloy and is manufactured from a wrought or rolled ingot, the cooling plate having a front side and a rear side, the cooling plate comprising grooves on the front side thereof for receiving refractory material, further comprising cooling ducts on the rear side of the cooling plate, the cooling ducts being partially defined by the cooling plate and partially by sheet metal pieces, the cooling ducts comprised of open, recessed milled ducts in the rear side of the cooling plate covered by the sheet metal pieces.

2. The cooling plate according to claim 1, wherein the cooling ducts are in addition formed by deep-drawing or bending of the sheet metal pieces.

3. The cooling plate according to claim 1, wherein the open, recessed milled ducts have a width and a depth, wherein the width is greater than the depth.

4. The cooling plate according to claim 1, wherein the sheet metal pieces are of steel.

5. The cooling plate according to claim 1, wherein the sheet metal pieces are of copper.

6. A cooling plate for shaft furnaces provided with a refractory lining, wherein the cooling plate is composed of copper or a low-alloy copper alloy and is manufactured from a wrought or rolled ingot, the cooling plate having a front side and a rear side, the cooling plate comprising grooves on the front side thereof for receiving refractory material, further comprising cooling ducts on the rear side of the cooling plate, the cooling ducts being partially defined by the cooling plate and partially by a sheet metal plate, the cooling ducts comprised of open, recessed milled ducts in the rear side of the cooling plate covered by the sheet metal plate.

7. The cooling plate according to claim 1, wherein the sheet metal pieces are at least one of welded and screwed to the cooling plate.

8. The cooling plate according to claim 6, wherein the sheet metal plate is at least one of welded and screwed to the cooling plate.

* * * * *